United States Patent [19]

Fujishige et al.

[11] 4,445,934

[45] May 1, 1984

[54] METHOD OF MANUFACTURING ALUMINUM BY USING BLAST FURNACE

[75] Inventors: Masao Fujishige; Masayuki Dokiya; Tetsuya Kameyama; Harumi Yokokawa; Seiichi Ujiie; Kenzo Fukuda; Akihiro Motoe, all of Yatabemachi, Japan

[73] Assignee: Agency of Industrial Science and Technology, Tokyo, Japan

[21] Appl. No.: 463,595

[22] Filed: Feb. 3, 1983

[30] Foreign Application Priority Data

Jun. 22, 1982 [JP] Japan ..... 57-107330

[51] Int. Cl.[3] ..... C22B 21/02

[52] U.S. Cl. ..... 75/68 A

[58] Field of Search ..... 75/68 R, 68 A, 10 R

[56] References Cited

U.S. PATENT DOCUMENTS

| | | | |
|---|---|---|---|
| 3,661,561 | 5/1972 | Frey, Jr. et al. | 75/68 R |
| 3,661,562 | 5/1972 | Seth et al. | 75/68 A |
| 4,299,619 | 11/1981 | Cochran et al. | 75/68 A |

*Primary Examiner*—M. J. Andrews

*Attorney, Agent, or Firm*—Armstrong, Nikaido, Marmelstein & Kubovcik

[57] ABSTRACT

This invention provides a method of smelting aluminum by using a blast furnace. An oxygen gas is introduced into a carbon material packed in a reactor, to burn the same to form a plurality of raceways and a high-temperature reduction region among the raceways. A mixture containing an alumina-containing starting material and a carbon material is then supplied selectively into the high-temperature reduction region while substantially preventing the mixture from contacting the raceways, to reduce the alumina to aluminum.

5 Claims, 5 Drawing Figures

METHOD OF MANUFACTURING ALUMINUM BY USING BLAST FURNACE

BACKGROUND OF THE INVENTION

This invention relates to a method of smelting aluminum by using a blast furnace, and more particularly to a method of smelting aluminum, which permits suppressing the occurrence of a volatile aluminum component and a volatile silicon component, whereby the blocking of the blast furnace can be prevented and the yield of aluminum can be improved.

The aluminum is the most important fundamental metal material next to iron, and the demand therefor is increasing year by year at a high rate. However, the cost of energy has been increased on a worldwide scale in recent years, so that it has become difficult to manufacture aluminum in an area in which the cost of electric power is high, such as Japan. This is giving rise to very serious troubles in the industrial structure. In addition, it is predicted that the area of places having good conditions for the location of inexpensive hydraulic power stations will decrease on a worldwide scale in the future. Consequently, it is being demanded that an inexpensive, energy-saving method of manufacturing aluminum, an important industrial material, be developed A Bayer-Hall-Héroult method is a conventional method of manufacturing aluminum, which has been known from of old.

However, this method, in which it takes a long period of time to carry out extraction and crystallization operations in a Bayer step, a step of extracting alumina from bauxite, has a low productivity and causes an increase in the cost of equipment. Furthermore, a Hall-Héroult step, an electrolysis step in the above method, does not have any merits with respect to the scale thereof. This step is also industrially disadvantageous in that it causes an increase in the cost of equipment and requires a large amount of electric power. In addition, the above electrolysis step has already little left to be technically improved. Therefore, it has been demanded that a radically-improved, novel aluminum-smelting method be developed.

In order to eliminate these drawbacks encountered in the Bayer-Hall-Héroult method, many kinds of substitute aluminum-smelting methods including a reduction method using an electric furnace have been studied.

However, none of these methods have been so developed as to permit saving energy and reducing the aluminum manufacturing cost to such an extent that these methods can be used satisfactorily instead of the Bayer-Hall-Héroult method. These substitute methods are disadvantageous in that they require, as in a reduction method using an electric furnace, such an amount of electric power that is equal to or larger than that in the older methods, or in that they require, as in an aluminum chloride electrolysis method, a large amount energy and manufacturing cost in a material pretreating steps therein.

In recent years, a method of smelting aluminum by using a blast furnace, in which method a countercurrent moving bed is used to reduce starting alumina-containing material with a carbon material, has come to be discussed as a method capable of overcoming the problems in the above-mentioned aluminum smelting methods using the electric power. In this method using a blast furnace, a packed layer containing starting alumina-containing material, a fuel, and a carbon material working as a reducing agent is formed in the blast furnace to carry out therein simultaneously a combustion reaction (1) and a reduction reaction (2) of the following formulae.

$$C+\tfrac{1}{2}O_2 \rightarrow CO \quad (1)$$

$$Al_2O_3+3C \rightarrow 2Al+3CO \quad (2)$$

The reduction of aluminum oxide (alumina), which is expressed by the formula (2), is carried out by using as a heat source the heat generated in the combustion of a carbon material with oxygen, which is expressed by the formula (1). The blast furnace in use is of a countercurrent moving bed type, in which an oxygen gas is introduced thereinto from a lower portion of the blast furnace with a reduction product withdrawn from a bottom portion thereof. In accordance with a rate of withdrawal of the reduction product, a starting material is fed into the blast furnace from a top portion thereof. A packed layer as a whole moves downward as it keeps in countercurrent contact with a combustion gas occurring in a lower portion of the blast furnace.

Smelting aluminum by carrying out the above reactions (1) and (2) simultaneously in such a blast furnace has various kinds of technical problems to be solved for improving the economical and operation efficiencies.

Above all, the blocking of a blast furnace and a decrease in the yield of aluminum, which are caused by the generation and condensation of volatile aluminum components ($Al_2O$ and Al) and a volatile silicon component (SiO), are troublesome problems.

In order to suppress the occurrence of such volatile aluminum components and volatile silicon component, a method of adding an alloy component, such as iron to an alumina-containing starting material to lower a reducing temperature and to alloy a metallic aluminum product, whereby the metallic aluminum product can be stabilized to carry out the production of metallic aluminum advantageously, is usually employed.

However, even such a method has not yet been so developed as to thoroughly prevent the occurrence of volatile aluminum components and a volatile silicon component.

SUMMARY OF THE INVENTION

An object of the present invention is to provide an aluminum smelting method, which permits radically preventing the occurrence of volatile aluminum components and a volatile silicon component, which constitutes a drawback encountered in a conventional method of smelting aluminum by using a blast furnace.

Another object of the present invention is to provide a method of smelting aluminum by using a blast furnace, which is not blocked up while it is in operation.

Still another object of the present invention is to provide a method of smelting aluminum by using a blast furnace, capable of increasing the yield of aluminum not less than two times that in a conventional method of this kind.

These objects of the present invention can be achieved by supplying an oxygen gas into a reactor filled with a carbon material, to burn the same material and form a plurality of raceways and a high-temperature reduction region among these raceways, and selectively supplying a mixture, which contains an alumina-containing starting material and a carbon material, into the high-temperature reduction region while substantially preventing the mixture from contacting the raceways, to reduce the alumina in the alumina-containing starting material to aluminum.

BRIEF DESCRIPTION OF THE DRAWINGS

FIGS. 1*a* and 1*b* illustrate raceways formed in a reactor, wherein:

FIG. 1*a* is a longitudinal sectional view, and FIG. 1*b* is a horizontal sectional view;

DESCRIPTION OF THE PREFERRED EMBODIMENTS

According to the present invention, an oxygen gas is supplied into a reactor filled with a carbon material, to burn the same material and form a plurality of raceways. For example, as shown in FIGS. 1*a* and 1*b*, three water-cooled type, oxygen gas introducing lances 1, 2, 3 are provided on a cylindrical wall of a cylindrical reactor to supply an oxygen gas therefrom into the reactor and burn a carbon material C placed therein, whereby three raceways 4, 5, 6 are formed in a carbon material-filled bed. As a result, regions M spaced from the raceways are formed in the vicinity of the central portion of the reactor. At this time, a molten layer consisting of slag and crude alloy is formed under the raceways. Consequently, a CO gas occurring in the raceways is spread mainly into the interior of the reactor from upper portions of the raceways. The "raceways" referred to above mean combustion regions formed in the bed filled with the carbon material C when a combustion oxygen gas is introduced thereinto to burn the carbon material. In the raceways, flames are formed due to the combustion of the carbon material. These raceways form a high-temperature region in the reactor, and places, to which oxygen is supplied, and, therefore, they can also be called "oxidation regions". On the other hand, the portions M spaced away from the raceways have a low temperature as compared with the portions constituting the raceways, and receive no oxygen. Thus, the portions M form high-temperature reduction regions.

In a conventional method of this kind, an alumina-containing material and a carbon material are packed at random into a bed to be filled therewith. Accordingly, the alumina-containing material is supplied into not only the portions constituting the reduction regions M but also the portions constituting the raceways. This causes a volatile aluminum component and volatile silicon component to occur.

Figure 1:
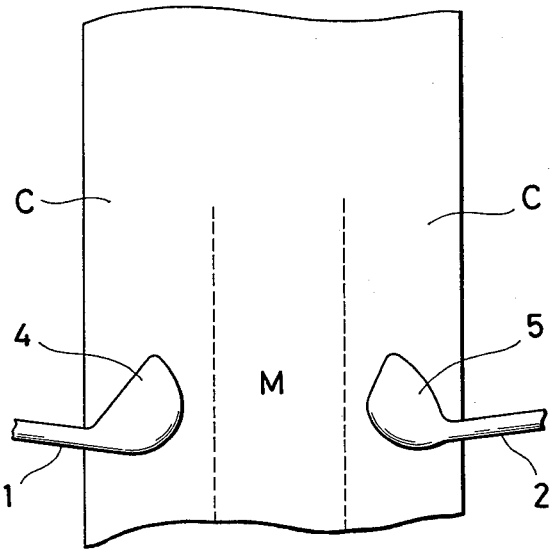
Figure 1:
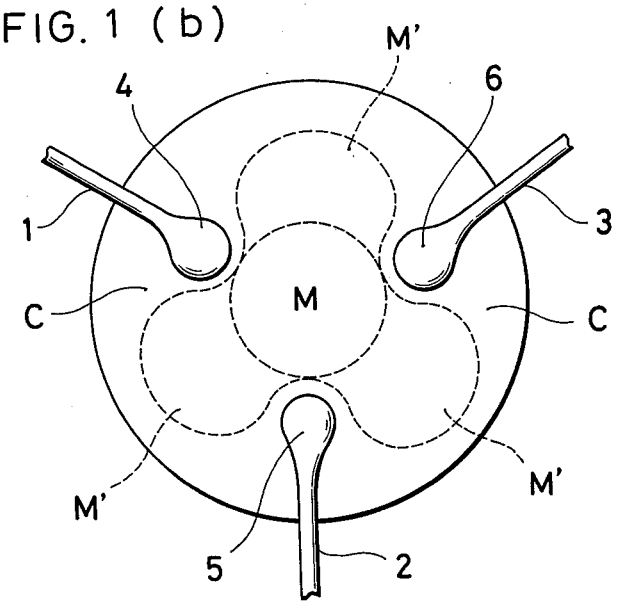
Figure 2:
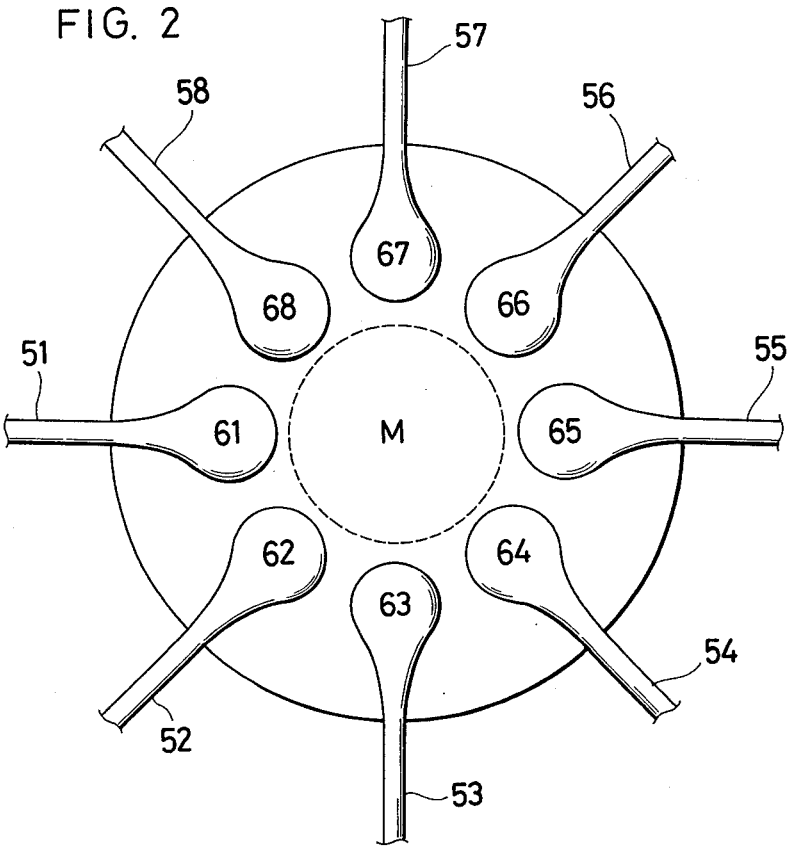
FIG. 2 is a horizontal sectional view of a reactor, in which an increased number of raceways are formed.

FIG. 2 is a horizontal sectional view of an example of a reactor, in which a plurality of raceways are formed in a circumferential portion thereof. Reference numerals 51–58 denote oxygen lances, and 61–68 raceways. Reference letter M denotes a high-temperature reduction region formed in the central portion of the reactor. According to the present invention, an alumina-containing starting material with a required carbon material is selectively supplied to a high-temperature reduction region M, which is formed in the central portion of a reactor and among raceways as shown in FIG. 1, in such a manner that the mentioned materials do not substantially contact the raceways.

According to the present invention, there are many methods of selectively supplying an alumina-containing starting material and a carbon material to the reduction region M. The methods include, for example, a method, in which large lump ores (each of which consists of a cube with one side 5–10 cm long or a ball having a diameter of 5–10 cm) consisting of an alumina-containing material and a carbon material are lowered into the central portion only of a reactor; a method, in which a rod type molded product, such as a cross-sectionally square or circular elongated molded product, of an alumina-containing material and a carbon material is supported on a retainer, such as a wooden frame, a metal frame, or a tubular body, and lowered into a reduction region M; a method, in which a mixture of an alumina-containing material and a carbon material is packed in a tubular body, such as a pipe or a tubular metal net and supplied into a reduction region M; and a method, in which a tubular supply means consisting of a high-temperature-resisting material is extended to a position just above a reduction region to supply an alumina-containing material and a carbon material thereinto from the mentioned position.

Figure 3:
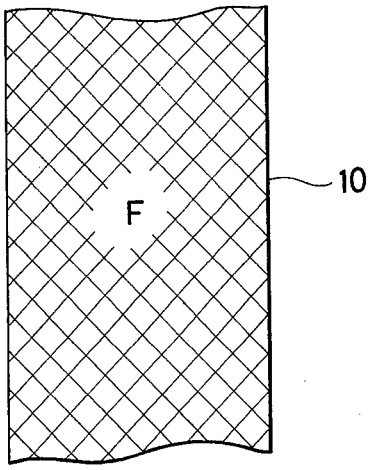
FIG. 3 is a fragmentary side elevational view of a cylindrical metal net used for supplying a mixture containing an alumina-containing starting material and a carbon material into high-temperature reduction regions.

FIG. 3 shows an example of a mixture F of an alumina-containing material and a carbon material and packed in a cylindrical metal net 10. When such a packed body is lowered continuously at its front end from a top portion of a reactor into a reduction region M, a mixture F of an alumina-containing material and a carbon material can be selectively supplied into the high-temperature reduction region M in such a manner that the mixture F does not substantially contact raceways. At this time, the front end portion of the cylindrical metal net 10 is melted. This molten iron component serves to lower an alumina-reducing temperature. Furthermore, a plurality of such elongated packed bodies can be supplied into the reduction region M. A reduction region is not necessarily formed in the central portion only of a reactor; as is clear from FIG. 1, reduction regions M′ are also formed in the portions of the circumferential section of a reactor which are among raceways. Accordingly, packed bodies can be supplied into the reduction region M′ as well. In addition, supplementary components can be added to a mixture of an alumina-containing material and a carbon material. When a flux, for example, $CaCO_3$, CaO, or blast furnace slag is mixed with such a mixture, the melting point of the alumina can be decreased, so that the alumina can be supplied in the form of a liquid into a reduction region M. Unlike a conventional electrolysis method, the method according to the present invention permits employing a wide range of materials as the alumina-containing material. The bauxite having a high alumina content, a clay, such as band shale having a low alumina content, fly ash, and bottom ash can also be used as a starting material in the present invention.

A reaction for reducing pure alumina in accordance with the above-mentioned reaction formula (2) requires a high temperature of 2100°–2200° C. This reducing temperature can be lowered to around 1900° C. by adding an iron component or a silicon component to a starting material. The inventors of the present invention, who discussed from various points of view the content of iron in an alumina-containing starting material, discovered that increasing the iron content in a starting material serves very effectively not only to decrease an alumina-reducing temperature, but also to substantially suppress the occurrence of volatile components, such as $Al_2O$ and SiO produced according to following reaction formulae, which adversely affects the operation of a reactor, $$Al_2O_3+2C \rightarrow Al_2O+2CO \quad (3)$$

$$SiO_2+C \rightarrow SiO+CO \quad (4)$$

In order to effectively suppress the occurrence of volatile components, it is desirable that the content of an iron component be not less than a predetermined level with respect to the contents of aluminum and silicon components in an alumina-containing starting material, and that atomic ratios of Fe/Al and Fe/Si be not less than 1/7 and not less than 1, respectively, and preferably not less than ¼ and not less than 2, respectively.

The carbon material used in the present invention is divided into a carbon material used for the combustion [above reaction formula (1)] in a reactor, and a carbon material supplied in the form of a mixture of itself and an alumina-containing material as a reducing agent [above reaction formula (2)] for the alumina. Coke or coal is usually used as a carbon material for the combustion in a reactor.

These carbon materials are usually used in the form of small lumps, the diameter of which is smaller than that of the injection outlet of an oxygen lance to be described later. When oxygen lances with outlets having a diameter of, for example, 10 mm are employed, a granular carbon material having a diameter of 4–7 mm is preferably used. When a combustion carbon material having an excessively large diameter is used, isolated raceways are not formed, and a combustion reaction occurs in every part of the interior of the reactor due to the oxygen gas supplied thereinto. In addition to coal and coke, carbides, such as $Al_4C_3$, SiC, and FeC can also be used as a carbon material supplied to a reactor with an alumina-containing material. These carbon materials work as reducing agents, and they may be used in such an amount that is large enough to reduce the alumina contained in a starting material.

The present invention will now be described with reference to the drawings.

Figure 4:
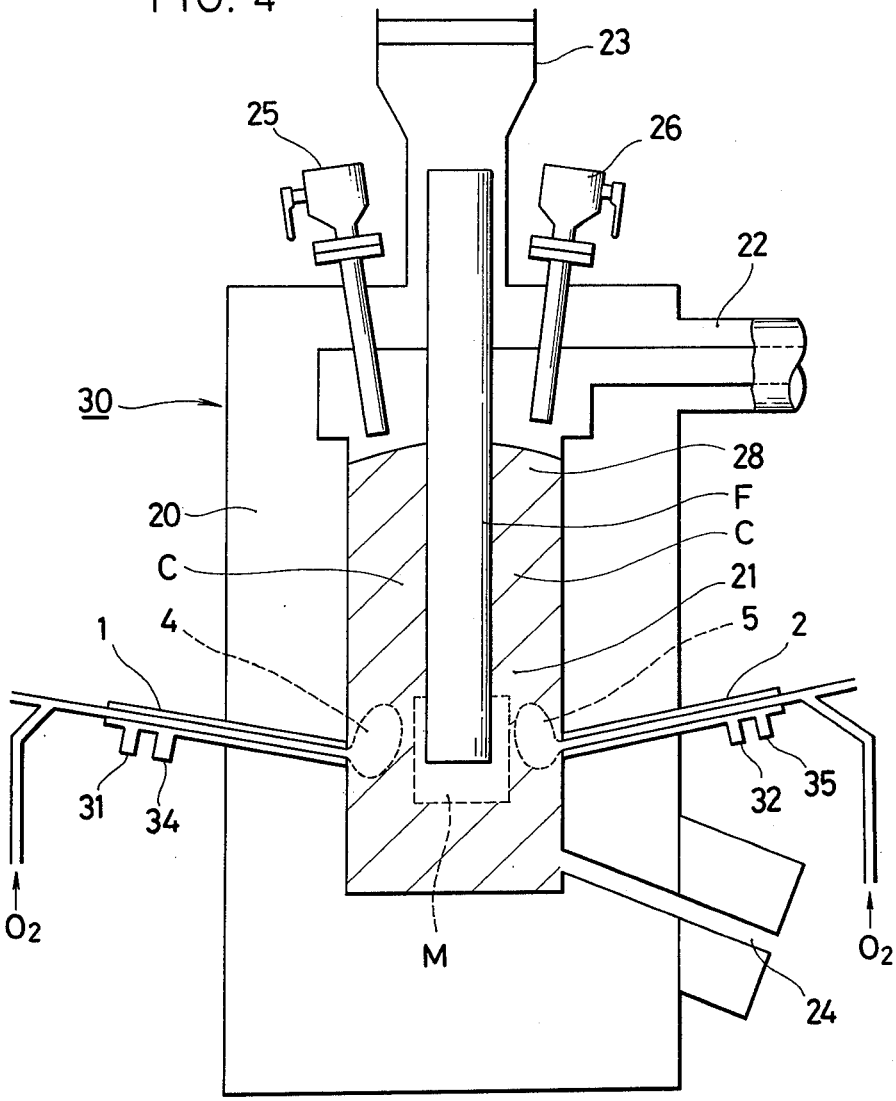
FIG. 4 is a longitudinal sectional view of an apparatus used to practice the present invention.

FIG. 4 shows an example of a reactor used in the present invention. A reactor 30 is formed with a furnace wall 20 consisting of fire bricks and a shell. The interior 21 of the reactor 30 is filled with a carbon material C, and a waste gas discharge duct 22 is provided at an upper portion of the reactor 30. A feeder 23 for supplying a mixture, which consists of an alumina-containing material and a carbon material, is provided in the vicinity of the central section of an upper portion of the reactor 30.

On the other hand, three means 25, 26, 27 (means 27 is not shown) for supplying a combustion carbon material are provided symmetrically at an upper portion of the reactor 30 in such a manner that the means 25, 26, 27 surround the feeder 23 for supplying a mixture of an alumina-containing material and a carbon material. In addition, three water-cooled type oxygen lances 1, 2, 3 (lance 3 is not shown), which are opened in an inner surface of the reactor 30, are provided symmetrically at a lower portion of the same reactor 30.

In order to practice the method according to the present invention, the carbon material C (coke) is packed into the reactor 30, and an oxygen gas is supplied thereinto through the water-cooled type oxygen lances 1, 2, 3 made of copper, to burn the coke and sufficiently preheat the interior of the reactor 30. At this time, the cooling water is introduced into the oxygen lances 1, 2, 3 from inlets 31, 32, 33 (inlet 33 is not shown) and discharged from outlets 34, 35, 36 (outlet 36 is not shown).

A mixture of an alumina-containing material and a carbon material, F, which is molded in the shape of a rod, is then lowered through the feeder 23 until a front end thereof has reached the portion M (usually the level of a tuyere), and the carbon material C is supplied from the means 25, 26, 27. As a result, a rod type molded product F, which consists of an alumina-containing material and a carbon material, is packed in the central portion of the reactor, and the carbon material C therearound. The carbon material C is preferably packed into the reactor in the form of a mixture of itself and a flux (slag-forming agent) or in the form of a lamination of layers of a carbon material and layers of a flux, which are arranged alternately. In the case where a lamination, in which layers of a carbon material and layers of a flux are alternately arranged, is packed in a reactor, the layers of a flux are melted when they are lowered to a position above raceways 4, 5, 6 (raceway 6 is not shown), to prevent the high-temperature CO gas, which occurs in the raceways, from rising vertically, and promote the advancement of the CO gas toward the central portion of the reactor.

Consequently, the temperature in the central portion of the reactor increases speedily, so that the high-temperature reduction region M can be expanded.

The flux material utilized in the present invention includes a material capable of converting silica and alumina, which are contained in a carbon material, into slag, a mineral containing a calcia component, for example, limestone, a mineral containing a magnesia component, such as dolomite, and iron blast furnace slag, a kind of industrial waste.

When an aluminum smelting operation is carried out in the above-mentioned manner, a reduction region M is formed in the portion of the interior of the reactor which is substantially equidistant from the raceways. In the region M, the molded product F, which consists of an alumina-containing material and a carbon material, is melted and reduced from its front end portion. The reduced aluminum usually turns into a solution in the form of an alloy consisting of the iron component added to the reaction zone for decreasing a reduction temperature, and the silicon, iron and titanium contained in the alumina-containing starting material and carbon material, the solution flowing down from a gate 24.

In accordance with the degree of progress of a reaction, a carbon material is fed from the combustion carbon material supply means 25, 26, 27, and a molded product consisting of an alumina-containing material and a carbon material is lowered naturally or by applying pressure thereto. When this molded product has been shortened, another piece of molded product is added and supplied into the reactor in the same manner.

The reaction mechanism in the present invention will now be discussed.

If, in the present invention, an alumina-containing material is supplied into the central portion of a reactor by lowering the former into the latter naturally, a reaction progresses quickly in the raceway portions, i.e. the circumferential portion of the interior of the reactor, and, therefore, the portion of the packed material which is in the circumferential portion of the interior of the reactor is consumed at a higher rate than in the central portion M. Consequently, only a smaller amount of alumina-containing material is supplied into the central portion M of the reactor; in practice, the greater part of the alumina-containing material is forced out to the circumferential portion of the reactor. Namely, the alumina-containing material is supplied chiefly into the raceway portions. As mentioned previously, the temperature in the raceway portions is far higher (2200°-2700° C.) than the temperature of 1900°-2200° C., which is required to carry out the reduction of pure alumina, and a mixture of alumina, iron and a silicon compound. Also, a partial pressure of oxygen in the raceway portions is high owing to the combustion oxygen supplied thereinto. Since the raceway portions are formed around a tuyere, a velocity of flow of a gas is extremely high. Accordingly, the alumina-containing material supplied into the raceways is once reduced but a part of the reduced material reacts with oxygen to turn into a volatile $Al_2O$ gas, still another part thereof turning to alumina vapor. Moreover, their partial pressures in the raceway portions is higher than those in the other regions in the reactor since the temperature in the raceway portion is higher. The $Al_2O$ gas and aluminum vapor occurring in the raceways are transferred to a top portion of the reactor with a high-speed gas current advancing from the raceways to the top portion of the reactor. As a result, the generation of Al and $Al_2O$ is further accelerated, and the greater part of the alumina supplied into the reactor is transferred upward as a volatile substance. The Al and $Al_2O$ gas thus transferred to a top portion of the reactor are cooled in the same portion thereof and reacts at the same time with a CO gas to turn into alumina, which form shelf type deposite in the packed bed and between the packed bed and the wall of the reactor. This causes the reactor to be blocked up and a part of the deposite is discharged to the outside of the reactor in the form of fine powder. The above results in a great decrease in the yield of reduced aluminum or an aluminum alloy. The facts mentioned above in connection with alumina are also applicable to the silica component contained in the alumina material.

The present invention, which has been developed with a view to settling the above-mentioned troublesome problems, permits suppressing the occurrence of a volatile aluminum component and a volatile silicon component, and thoroughly eliminating the problem of blocking of a reactor and a problem of a decrease in the yield of aluminum.

According to the present invention, an alumina-containing starting material is not supplied into raceways; it is selectively supplied into the central portion M of a reactor. The central portion M is isolated from raceways and has no partial pressure of oxygen. Consequently, it forms a reduction region, and has a temperature of around 1900°-2200° C., i.e. a temperature required for the reduction of pure alumina and a mixture of alumina, iron and a silicon compound.

Therefore, the generation of a volatile aluminum compound and a volatile silicon compound from the above-mentioned alumina-containing material can be prevented, and a problem of blocking of a reactor can be settled. Moreover, the yield of aluminum can be improved remarkably.

In order to completely settle the problem of blocking of a reactor in the present invention, it is preferable that a temperature in the uppermost portion of a packed bed be controlled to so high a level that an extremely small amount of a volatile aluminum component and a volatile silicon component generated in the reactor are not condensed. Namely, it is preferable to detect a temperature in the uppermost portion 28 (or a portion in the vicinity thereof) of a packed bed as operational information, and to vary on the basis of the information one or not less than two of (a) a feed rate of an oxygen gas, (b) a ratio of an amount of a combustion carbon material to that of an alumina-containing material, and (c) the height of a packed bed, and thereby control a temperature in the uppermost portion of the packed bed to a level not lower than that of a minimum temperature (critical operational temperature), at which the reactor is not blocked up, i.e. to a temperature in the range of a critical operational temperature plus not higher than 300° C., preferably a temperature in the range of between a critical operational temperature and a critical operational temperature plus 200° C. The critical operational temperature referred to above is usually in the range of 650°-800° C.

The present invention will now be described in more detail on the basis of its embodiments.

EXAMPLE 1 AND COMPARATIVE EXAMPLE

The reduction of bauxite was carried out by using a reactor (having an inner diameter of 36 cm and a height of 80 cm) shown in FIG. 4. 1000 parts by weight of bauxite, 300 parts by weight of coke powder and 62 parts by weight of iron powder were kneaded in the presence of water, and the kneaded product was molded into a square pillar of about 20 mm×50 mm×800 cm having a sufficiently high strength. The molded product thus obtained was dried. The resulting product was sandwiched between two wooden plates of about 5 mm×50 mm×800 mm and tied together with a metal wire. Coke having a particle size of 4-7 mm was used as a combustion carbon material.

First, the coke was packed into a lower portion of the reactor (up to a level 50 cm above a tuyere), and an oxygen gas was introduced into the reactor through three water-cooled oxygen lances to burn the coke packed therein, and thereby sufficiently preheat the reactor.

The coke was fed into the reactor continuously in such a manner that the height of the packed layer of coke was always in a predetermined level (80 cm above the bottom surface of the reactor).

During the above-described operation, the molded product of bauxite and coke was reduced from a lower end thereof to flow downward as the reaction progressed. Before the molded product of bauxite and coke has been shortened to be buried in the packed bed, a subsequent molded product of bauxite and coke was prepared and placed in the reactor to be added to the preceding molded product of bauxite.

A total feed rate of oxygen was 90 l/min (30 l/min per one lance, which has a diameter of 10 mm), and a lowering rate of the molded product of bauxite and coke was 2.5 pieces (1 kg/piece) per hour. A feed rate of the combustion coke was about 6 kg per hour.

A slag-forming agent used together with the combustion coke, which had been prepared by kneading 1.3 parts by weight of bauxite with 1.2 parts by weight of calcium carbonate, molding the kneaded mass into a product having a diameter of 10 mm and a length of 10 mm, and drying the molded product. 3 parts by weight of the slag-forming agent thus obtained was mixed with 100 parts by weight of combustion coke, and the mixture was supplied into the reactor.

The above operation was carried out for ten hours. During the operation, 60 kg of coke, 1.8 kg of slag component and 25 kg of molded product of bauxite and coke were consumed, and 4 kg of crude, slag-containing alloy was recovered from a gate 24. After the reaction had been complete, 6 kg of crude, slag-containing alloy left in the bottom of the reactor was recovered. The total amount of metallic aluminum contained in these alloys was 0.54 kg, and the total amount of metallic iron contained in the same alloys 2 kg. The yield of aluminum calculated on the basis of the amounts of the iron component and alumina component contained in the bauxite consumed was about 10%. The ratio (by weight) of Al/Fe in the alloys obtained was 0.27.

An experiment was conducted for comparison's sake in the same manner as in Example 1 except that cylindrical granules of bauxite having a diameter of 10 mm and a length of 10 mm were used instead of the elongated molded product of bauxite and coke, which granules of bauxite were mixed with combustion coke and granules of slag component, the resulting mixed granules having been introduced into a reactor at random to be lowered. The yield of metallic aluminum in this experiment was about 4% (the amount thereof was about 0.2 kg). The ratio (by weight) of Al/Fe in the alloy obtained was 0.1.

EXAMPLE 2

A cylindrical body consisting of a metal net and having a diameter of 80 mm, a length of 800 mm and a mesh of 20 mm was inserted into the central portion of a reactor, and granulated bauxite and granulated flux were supplied into the cylindrical body at 2.5 kg/hour and 0.18 kg/hour, respectively. In the meantime, granulated combustion coke was supplied at 6 kg/hour into the portion of the interior of the reactor which is around the cylindrical body, in the same manner as in Example 1. The granulated combustion coke (having a diameter of 4–7 mm) and granulated slag component (having a diameter of 10 mm and a length of 10 mm) constituting the flux, all of which were used in this Example, are identical with those used in Example 1. The granulated bauxite used are spherical and have a diameter of about 30–40 mm. The granulated bauxite consists of 1000 parts by weight of bauxite, 300 parts by weight of coke powder and 62 parts by weight of iron powder just as the molded product consisting of bauxite and coke used in Example 1.

When these materials were supplied into the reactor to carry out a smelting operation, the granulated combustion coke and granulated slag component flowed through the meshes of the metal net to be packed in a circumferential portion of the reactor. The granulated bauxite was selectively supplied into the reduction region M in the reactor.

After the operation had been carried out for ten hours, 0.48 kg of metallic aluminum and 2 kg of metallic iron were recovered. The yield of aluminum was 9%. The ratio (by weight) of Al/Fe in the alloy obtained was 0.24.

The results of Examples 1 and 2 and Comparative Example were tabulated.

TABLE 1

| | Yield of aluminum | Al/Fe ratio |
|---|---|---|
| Example 1: | 10% | 0.27 |
| Example 2: | 9% | 0.24 |
| Comparative Example: | 4% | 0.10 |

As is clear from the above table, the present invention permits achieving a remarkable improvement in the yield of aluminum.

What is claimed is:

1. A method of smelting alumina using a blast furnace and comprising the steps of:

filling the blast furnace with a carbon material for combustion;

directing oxygen gas into said carbon material from the periphery of the furnace so as to form a plurality of combustion regions in which combustion of said carbon material takes place and which extend from the periphery of the furnace toward the center thereof and, at the same time, to form a high-temperature reduction zone in and about the center of the furnace, said high-temperature reduction zone being spaced apart from said combustion regions;

introducing into said high-temperature reduction zone and without contacting said combustion regions, a mixture of an alumina-containing material and a carbon material for reduction; and reducing the alumina of said alumina-containing material to aluminum in said high-temperature reduction zone with said carbon material for reduction.

2. A method of smelting aluminum using a blast furnace according to claim 1, wherein said carbon material for combustion is coke or coal.

3. A method of smelting aluminum using a blast furnace according to claim 1, wherein said carbon material for reduction is coal, coke or a carbide.

4. A method of smelting aluminum using a blast furnace according to claim 1, wherein said mixture of said alumina-containing material and said carbon material for reduction further contains a flux.

5. A method of smelting aluminum using a blast furnace according to claim 4, wherein said flux is $CaCO_3$, CaO or iron blast furnace slag.

* * * * *